US007971458B2

(12) United States Patent
Gilbert

(10) Patent No.: US 7,971,458 B2
(45) Date of Patent: Jul. 5, 2011

(54) BRACKET ASSEMBLY FOR LOCK

(75) Inventor: Mark Gilbert, Aubum, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 528 days.

(21) Appl. No.: 12/109,313

(22) Filed: Apr. 24, 2008

(65) Prior Publication Data

US 2009/0265902 A1 Oct. 29, 2009

(51) Int. Cl.
*E05B 69/00* (2006.01)

(52) U.S. Cl. ..... 70/58; 70/14; 248/552

(58) Field of Classification Search ..... 70/14, 18, 70/19, 57, 57.1, 58, 158–164; 248/551–553
See application file for complete search history.

(56) References Cited

U.S. PATENT DOCUMENTS 716,118 A * 12/1902 Scott ..... 292/1
4,027,798 A * 6/1977 Swaim ..... 211/4
4,038,843 A * 8/1977 Daley, Jr. ..... 70/58
4,047,686 A * 9/1977 Porter ..... 248/552
5,349,145 A * 9/1994 Kelaita et al. ..... 200/43.15
5,467,622 A * 11/1995 Becker et al. ..... 70/203
5,787,737 A * 8/1998 Cho ..... 70/58
6,006,557 A * 12/1999 Carl et al. ..... 70/58
6,095,574 A * 8/2000 Dean ..... 292/164
6,112,562 A * 9/2000 Murray et al. ..... 70/58
6,622,532 B2 * 9/2003 Hsu ..... 70/14
6,688,145 B2 * 2/2004 Tan ..... 70/58
6,691,537 B2 * 2/2004 Tan ..... 70/58
6,758,069 B2 * 7/2004 Derman ..... 70/58
6,886,377 B2 * 5/2005 Cohen ..... 70/62
7,007,912 B1 * 3/2006 Giuliani et al. ..... 248/552
7,204,106 B2 * 4/2007 Merrem et al. ..... 70/14
7,227,747 B2 * 6/2007 Walker et al. ..... 361/679.41
7,294,032 B1 * 11/2007 Ventura ..... 441/75
7,475,575 B1 * 1/2009 Greenfield et al. ..... 70/18
7,487,652 B2 * 2/2009 Marszalek et al. ..... 70/58
7,639,133 B1 * 12/2009 Kelsch et al. ..... 340/545.6
7,640,772 B2 * 1/2010 Johnson ..... 70/2
2004/0040350 A1 * 3/2004 Derman ..... 70/58
2004/0261474 A1 * 12/2004 Galant ..... 70/58
2008/0264118 A1 * 10/2008 King ..... 70/58
2010/0186465 A1 * 7/2010 Frantz ..... 70/58

* cited by examiner

*Primary Examiner* — Suzanne D Barrett

(57) ABSTRACT

One embodiment is a bracket assembly having a first bracket connected to an electronic device with a fastener and an opening that receives a lock. A second bracket covers access to the fastener to prevent the first and second brackets from being disassembled while the lock is secured to the first and second brackets.

17 Claims, 7 Drawing Sheets

BRACKET ASSEMBLY FOR LOCK

BACKGROUND

Since many electronic devices are small and portable, these devices are often lost or stolen. In order to deter theft, locks are used to secure electronic devices to a stationary object. Personal computers, for example, can include a receptacle that receives a lock attached to a security cable. This receptacle is manufactured into the body of the computer or device and has a specific shape to mate with the lock.

Many electronic devices, however, are not manufactured with a receptacle to receive a lock. These devices are more difficult to secure since locks are often not readily attachable to the electronic device.

Further, many locks have a specialized connector that must be inserted into a recess or slot sized and shaped to receive the connector. The electronic device needs this specific slot to attach with the connector on the lock. If the electronic device does not have the correct slot, then the device cannot couple to the lock.

DETAILED DESCRIPTION

Figure 1A:
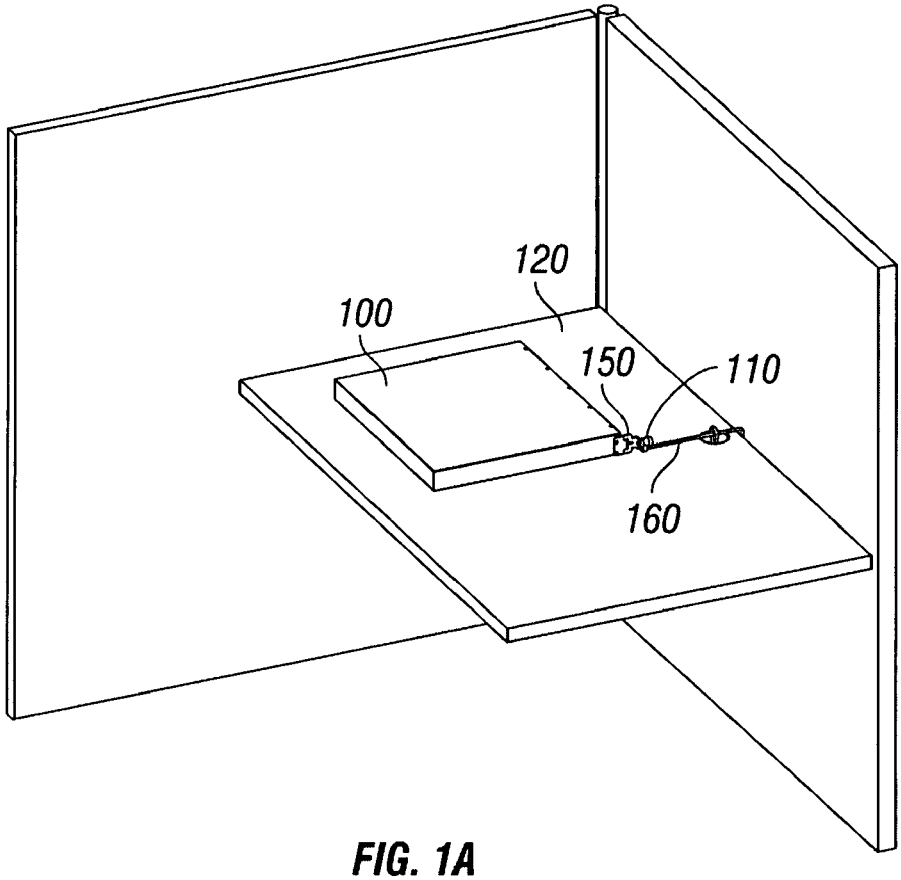
FIG. 1A is a perspective view of an electronic device secured with a lock to a support member in accordance with an exemplary embodiment.

Exemplary embodiments are directed to apparatus, systems, and methods for locking or securing electronic devices.

A bracket assembly connects to the electronic device and provides a mechanism for attaching a lock to the electronic device.

One embodiment provides a security lock attachment bracket assembly for electronic devices that uses standard attachment screws. The bracket assembly includes a pair of sheetmetal brackets. One bracket is affixed to the electronic device using one or more standard flathead metal screws. The second bracket is inserted through the first bracket in a manner to prevent further access to the attachment screws. A security lock is then inserted through an appropriate slot in both brackets.

Once the lock is locked to the brackets, a person is prevented from removing the brackets from the electronic device. In other words, while the lock is locked to the bracket assembly, the two brackets cannot be disassembled since the screws are not accessible.

The design of the bracket assembly is such that the lock can be attached to multiple (for example, four) different positions to minimize obstruction created by the brackets and the lock.

One embodiment includes two brackets with matching slots that receive a lock. One of the brackets includes a particular shaped additional slot (for example, a horizontal T shaped slot), and the other bracket includes a corresponding tab (for example, a horizontal T-shaped protrusion) that is perpendicular to a main plane or body of the bracket. Both brackets also include one or more attachment holes (for example, two countersunk holes to receive flathead screws). These holes are offset, so as not to align when the two brackets are attached together or superimposed via the slot and tab features.

In one embodiment, a method of use includes attaching one of the brackets to existing threaded holes in an outer housing of an electronic device using fasteners (such as flathead screws) so that the fasteners are flush with a surface of the bracket. Next, the second bracket is positioned such that the particular shaped tab (for example, T-shaped) fits through the particular shape slot (for example, T-shaped) in the other bracket. The second bracket is slid over or aligned with the first bracket until the lock receiving slots of the two brackets align. Next, a lock tip (for example, a T-shaped protrusion) is inserted through the slot. A key is used to turn the tip until the lock secures the two brackets together.

In one embodiment, both brackets include attachment screw holes. The attachment screw holes of the second bracket, however, do not align with the screw holes of the first bracket to prevent the removal of the bracket assembly and lock (i.e., prevent access to the screws while the two brackets are superimposed). If the second bracket is connected or screwed first to the electronic device, the assembly and functionality is similar to when the first bracket is connected to the electronic device. As one difference, one end of the tabs (forming an L-shape) with the second slot for receiving the lock provides an alternative location of the lock and minimizes obstruction.

Exemplary embodiments are not limited to any particular size and shape of bracket assemblies. Further, various male and female connectors can be used to connect the brackets together or connect the brackets to the lock. By way of example, instead of using a slot and formed tab, embodiments can use custom designed press-in-metal fasteners. Such fasteners have one end or head similar to a shape of a nail head. This head protrudes from and is riveted into the bracket. This type of head or fastener can be affixed to each bracket in opposing locations so that a keyhole slot in the opposing bracket slips over the head of the fastener and retains the brackets together when one bracket is slid against the other to a position where corresponding slots align to receive the lock.

Another exemplary embodiment includes two brackets having an L-shape (an attachment portion and a flange) with each bracket including matching slots to receive a lock. One bracket includes an additional large slot to receive one end of the second bracket. This second bracket passes through the large slot to position the two brackets on top of each other. Both brackets also include attachment holes (for example, two countersunk holes to match flathead screws) that are offset. This offset is sufficient so the holes do not align or overlap when the two brackets are assembled together.

Exemplary embodiments provide various mechanisms for connecting the first and second brackets together. The fact that the brackets are intertwined keeps them from being separated and prevents access to the fasteners (for example, the attachment screws used to hold one of the brackets to the electronic device). As such, when the brackets are locked to the electronic device, they cannot be separated or moved to provide access to the fasteners.

FIG. 1A is a perspective view of an electronic device 100 secured with a lock 110 to a support member 120 in accordance with an exemplary embodiment. The lock 110 connects to the electronic device 100 with a securing mechanism 150 to prevent the electronic device from being moved.

The lock 10 and securing mechanism 150 are used to secure a wide variety of portable and non-portable computers and/or electronic devices (shown generally as electronic device 100). Such electronic devices include, but are not limited to, computer systems, computers (portable and non-portable), servers, main frame computers, distributed computing devices, laptops, memory or storage devices (such as hard drives), networking switches, monitors, televisions, gaming consoles, video projectors, electronic media players (such as digital video disk, DVD, or compact disk, CD players), and other electronic devices and systems, whether such devices and systems are portable or non-portable.

Figure 1B:
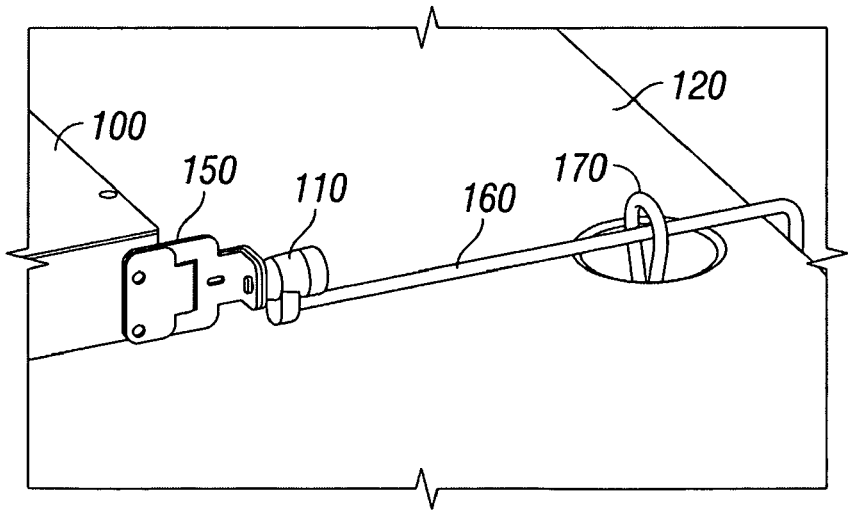
FIG. 1B is an enlarged view of FIG. 1A showing the securing mechanism and lock attached to the support member in accordance with an exemplary embodiment.

Exemplary embodiments are used with a wide variety of locks 110. Such locks form part of an anti-theft system for protecting and securing electronic devices. FIG. 1B is an enlarged view of FIG. 1A showing the securing mechanism 150 and lock 110 attached to the support member 120. By way of example, the support mechanism 120 is shown as a table, desk, surface, or other object to which the electronic device can be securely attached to prevent unauthorized or unwanted movement of the electronic device.

As shown, the lock 110 includes a cable 160 that securely attaches to the support member 120 for preventing the electronic device 100 from being moved. Locks are generally secured in place with a key or some mechanical pin device and attached to a rubberised metal cable 160. The end of the cable 160 has a small loop 170 that allows the cable to be looped around a permanent object, such as a heavy table or other similar equipment, in order to secure the electronic device 100.

The securing mechanism 150 and lock 110 are used in a variety of settings, generally as a deterrent to prevent opportunist theft. By way of illustration, individuals can use them in public places such as busy offices, coffee shops, libraries, etc. Companies can use the securing mechanism and lock to secure expensive equipment that is left unattended in public or private places, such as computer displays in a retail store, inventory in a warehouse, video projectors used in a hotel conference room, etc.

Figure 2A:
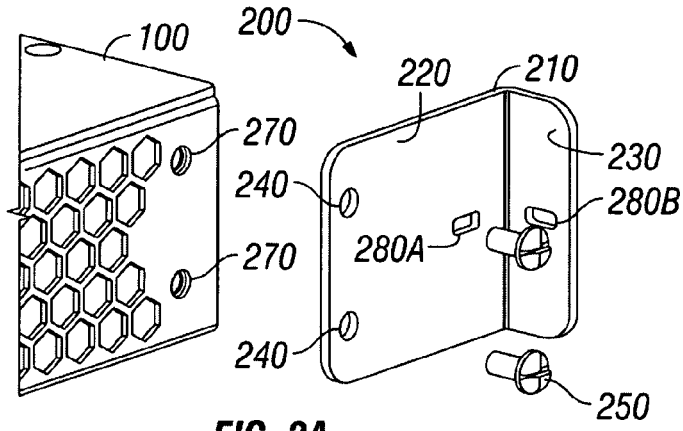
FIG. 2A is an enlarged view of a first securing mechanism before being attached to an electronic device in accordance with an exemplary embodiment.

FIG. 2A is an enlarged view of a first securing mechanism 200 before being attached to the electronic device 100 (discussed in connection with FIGS. 1A and 1B) in accordance with an exemplary embodiment. In this embodiment, the securing mechanism includes an integrally formed one-piece body 210 having a first or attachment portion 220 and a second portion or flange 230. Reference is simultaneously made to all of the FIGS. 2A-2E with specific attention given to figures when indicated.

The attachment portion 220 and flange 230 have a generally rectangular shape with the flange extending outwardly at a right angle from one end of the attachment portion. As shown, the attachment portion 220 is larger than the flange 230 and includes plural holes 240 for receiving fasteners 250.

As shown in FIG. 2A, the electronic device 100 includes plural holes 270 for receiving the fasteners 250. By way of illustration, these holes 270 are threaded bores or holes located at a back end or back side of an outer surface or body of the electronic device. The body 210 of the securing mechanism is shaped and size such that the holes 240 align with the holes 270 so the body can be securely attached to the electronic device with the fasteners 250.

In one exemplary embodiment, the fasteners 250 are tamper resistant or one-way screws. These screws can be tightened but not loosened with a standard screwdriver.

In some exemplary embodiments, the electronic device 100 does not include a hole or slot for receiving a lock. In other words, such electronic devices are manufactured without a hole or slot adapted to attach directly to a lock. Locks, however, can still be used to secure the electronic device since the securing mechanism provides an interface or mechanism for attaching the lock to the electronic device. Specifically, the securing mechanism includes one or more slots or openings 280A, 280B that are sized and shaped to receive the lock. One slot or opening 280A is provided through the attachment portion 220, and one slot or opening 280B is provided through the flange 230.

Since the originally manufactured electronic device was made without a slot or opening for attaching to the lock, the securing mechanism provides this slot or opening as an add-on or retrofit product. Exemplary embodiments thus provide a mechanism for attaching a lock to an electronic device that initially or originally was not adapted to connect to such a lock.

The size and shape of the slots or openings 280A, 280B can vary depending on the type of locks intended to secure the electronic device 100. By way of example, the slots or openings can have an elongated rectangular shape (for example, to receive a T-shaped projection on the lock), a triangular shape, or other shapes for engaging and securing to a lock.

Figure 2B:
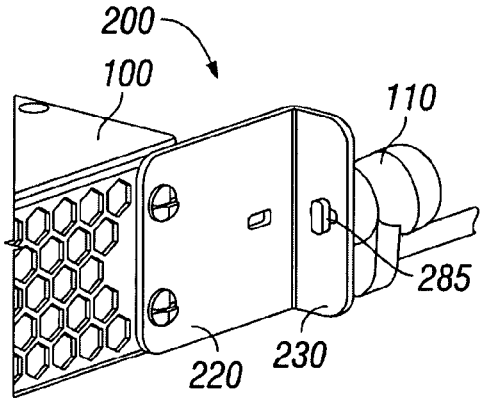
FIG. 2B is an enlarged view of the first securing mechanism attached in a first orientation with a lock at a first position in accordance with an exemplary embodiment.

FIG. 2B is an enlarged view of the first securing mechanism 200 attached in a first orientation with the lock 110 at a first position in accordance with an exemplary embodiment. In the first orientation, the flange 230 extends outwardly away from the electronic device. The lock includes a T-shaped projection 285 that fits through the slot or opening 280B in the flange 230.

Figure 2C:
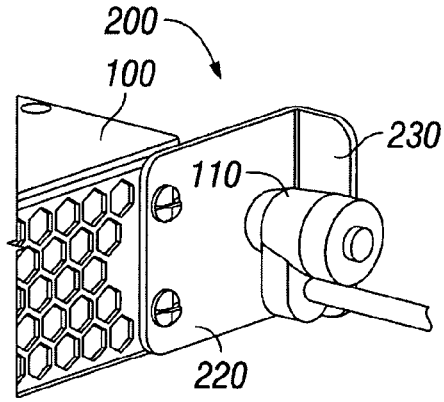
FIG. 2C is an enlarged view of the first securing mechanism attached in the first orientation with the lock at a second position in accordance with an exemplary embodiment.

FIG. 2C is an enlarged view of the first securing mechanism 200 attached in the first orientation with the lock 110 at a second position in accordance with an exemplary embodiment. In this second position, the T-shaped projection fits through the slot or opening 280A (shown in FIG. 2A) in attachment portion 220.

As shown in FIGS. 2B and 2C, the lock 110 can connect to the securing mechanism 200 at two different locations. In one location, the lock 110 connects to the flange 230, and in another location the lock connects to the attachment portion 220. These multiple attachment points provide the user with different locations or options for connecting the lock to the electronic device without having to remove the securing mechanism to provide additional attachment points.

Figure 2D:
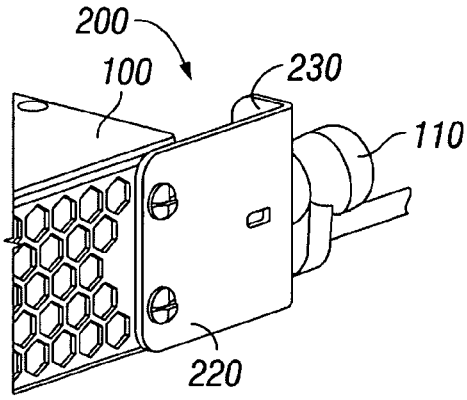
FIG. 2D is an enlarged view of the first securing mechanism attached in a second orientation with the lock at a first position in accordance with an exemplary embodiment.

FIG. 2D is an enlarged view of the first securing mechanism 200 attached in a second orientation with the lock 110 at a first position in accordance with an exemplary embodiment. In the second orientation, the flange 230 extends inwardly toward the electronic device. Here, the T-shaped projection (see FIG. 2B) extends through the slot or opening 280B in the flange 230 (see FIG. 2A).

Figure 2E:
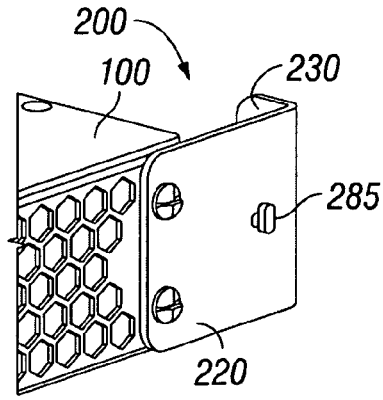
FIG. 2E is an enlarged view of the first securing mechanism attached in the second orientation with the lock at a second position in accordance with an exemplary embodiment.

FIG. 2E is an enlarged view of the first securing mechanism 200 attached in the second orientation with the lock 110 at a second position in accordance with an exemplary embodiment. Here, the T-shaped projection 285 extends through the slot or opening 280A.

FIGS. 2B-2E show that the securing mechanism is reversible to provide multiple different attachment configurations with the lock. In other words, it can be flipped or its orientation changed to provide at least four different orientations for attaching to the lock.

FIGS. 3A-3F show another embodiment wherein the securing mechanism 300 includes two separate brackets 305A and 305B. Each bracket includes a respective body 310A, 310B with an attachment portion 320A, 320B and flange 330A, 330B. Each bracket includes plural slots or openings 380 for attaching to the lock 110 (these slots or openings 380 discussed in more detail as slots or openings 280 in FIGS. 2A-2E). Reference is simultaneously made to all of the FIGS. 3A-3F with specific attention given to figures when indicated.

Figure 3A:
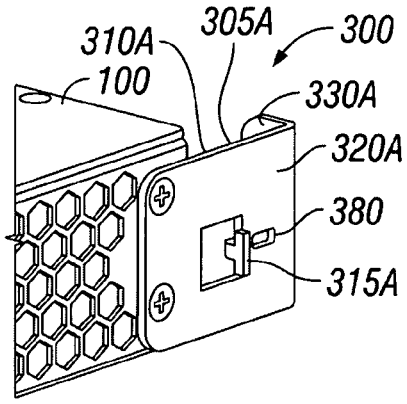
FIG. 3A is an enlarged view of a second securing mechanism with a first bracket attached in accordance with an exemplary embodiment.

FIG. 3A is an enlarged view of the second securing mechanism with the first bracket 305A directly attached to the electronic device 100 in accordance with an exemplary embodiment. The first bracket 305A includes a male projection (shown as a T-shaped tab 315A) for connecting or attaching the first bracket 305A to the second bracket 305B. As shown best in FIGS. 3A-3C, the male projection 315A fits through a corresponding female hole or slot (shown as a T-shaped slot 315B) located in the attachment portion 320B of bracket 305B.

Figure 3B:
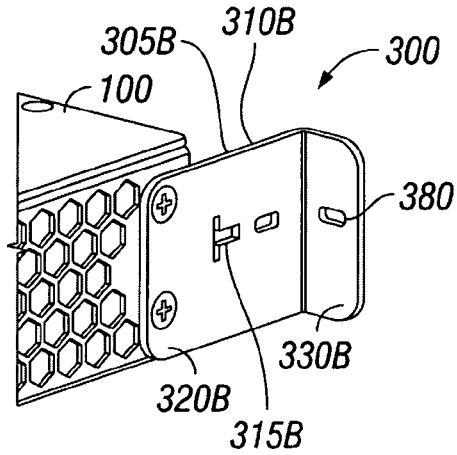
FIG. 3B is an enlarged view of the second securing mechanism with a second bracket attached in accordance with an exemplary embodiment.

FIG. 3B is an enlarged view of the second securing mechanism with the second bracket 305B directly attached to the electronic device 100 in accordance with an exemplary embodiment. The second bracket includes the female hole (shown as a T-shaped slot 315B) for receiving the male projection 315A to removably attach the first and second brackets together.

Figure 3C:
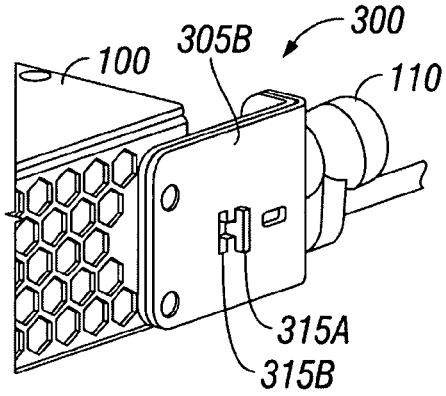
FIG. 3C is an enlarged view of the second securing mechanism with the second bracket attached to the first bracket and a lock in a first position in accordance with an exemplary embodiment.

FIG. 3C is an enlarged view of the second securing mechanism with the second bracket 305B directly attached to the first bracket 305A and the lock 110 in a first position in accordance with an exemplary embodiment. In this configuration, the flanges 330A and 330B extend inwardly toward the electronic device 100. The male protrusion 315A extends through the female hole 315B to temporarily secure the brackets together. In this first position, the lock 110 is attached at a first location (namely at the flanges 330A, 330B) of the securing mechanism 300.

Figure 3D:
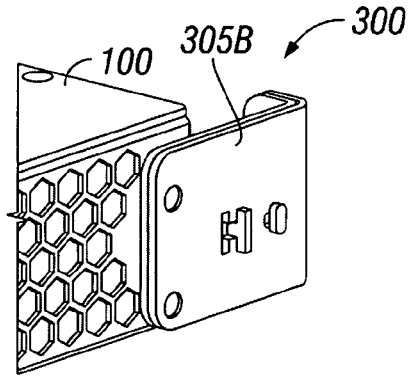
FIG. 3D is an enlarged view of the second securing mechanism with the second bracket attached to the first bracket and the lock in a second position in accordance with an exemplary embodiment.

FIG. 3D is an enlarged view of the second securing mechanism with the second bracket 305B directly attached to the first bracket 305A and the lock 110 in a second position in accordance with an exemplary embodiment. In this second position, the lock 110 is attached at a second location (namely at the attachment portions 320A, 320B) of the securing mechanism 300.

Figure 3E:
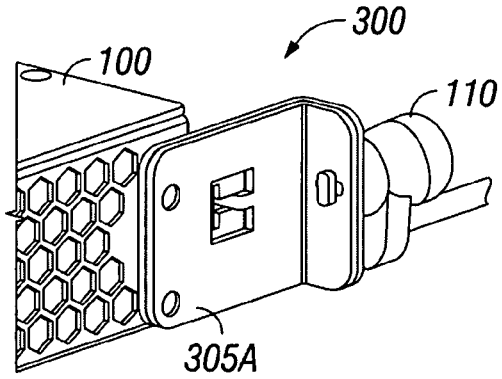
FIG. 3E is an enlarged view of the second securing mechanism with the first bracket attached to the second bracket and the lock in the first position in accordance with an exemplary embodiment.

FIG. 3E is an enlarged view of the second securing mechanism with the first bracket 305A directly attached to the second bracket 305B and the lock 110 in the first position in accordance with an exemplary embodiment. In this configuration, the flanges 330A and 330B extend outwardly away from the electronic device 100. In this first position, the lock 110 is attached at a first location (namely at the flanges 330A, 330B) of the securing mechanism 300.

Figure 3F:
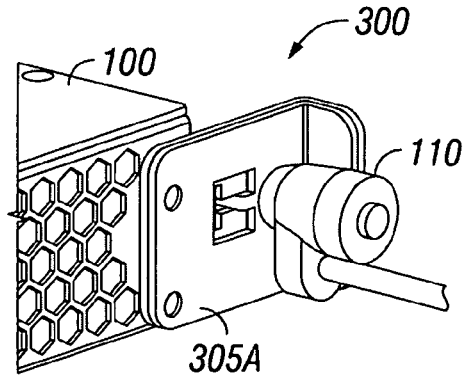
FIG. 3F is an enlarged view of the second securing mechanism with the first bracket attached to the second bracket and the lock in the second position in accordance with an exemplary embodiment.

FIG. 3F is an enlarged view of the second securing mechanism with the first bracket 305A directly attached to the second bracket 305B and the lock 110 in the second position in accordance with an exemplary embodiment. In this second position, the lock 110 is attached at a second location (namely at the attachment portions 320A, 320B) of the securing mechanism 300.

FIGS. 4A-4F show another embodiment wherein the securing mechanism 400 includes two separate brackets 405A and 405B. Each bracket includes a respective body 410A, 410B with an attachment portion 420A, 420B and flange 430A, 430B. Each bracket includes plural slots or openings 480 for attaching to the lock 110 (these slots or openings 480 discussed in more detail as slots or openings 280 in FIGS. 2A-2E). Reference is simultaneously made to all of the FIGS. 4A-4F with specific attention given to figures when indicated.

Figure 4A:
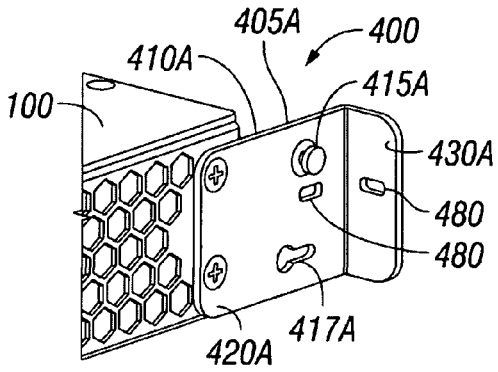
FIG. 4A is an enlarged view of a third securing mechanism with a first bracket attached in accordance with an exemplary embodiment.

FIG. 4A is an enlarged view of a third securing mechanism with a first bracket attached in accordance with an exemplary embodiment. The first bracket 405A includes a male projection (shown as a round or nail-head shaped fastener 415A) for connecting or attaching the first bracket 405A to the second bracket 405B. As shown best in FIGS. 4A-4C, the male projection 415A fits through a corresponding female hole or slot (shown as a key-hole slot 417B) located in the attachment portion 420B of bracket 405B.

Figure 4B:
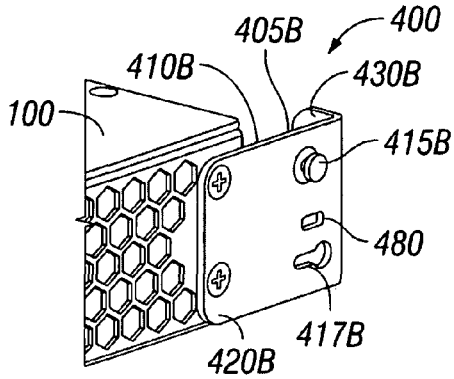
FIG. 4B is an enlarged view of the third securing mechanism with a second bracket attached in accordance with an exemplary embodiment.

FIG. 4B is an enlarged view of the third securing mechanism with the second bracket 405B directly attached to the electronic device 100 in accordance with an exemplary embodiment. The second bracket includes the female hole or slot 417B for receiving the male projection 415A to removably attaching the first and second brackets together.

As shown in FIGS. 4A and 4B, each of the brackets includes both male and female connection mechanisms. Bracket 405A includes a male connector 415A and a separate female receptor 417A. Likewise, bracket 405B includes a male connector 415B and a separate female receptor 417B. These male and female connectors enable the securing mechanism 400 to be attached to the electronic device in a variety of orientations (as shown in FIGS. 4C-4F).

Figure 4C:
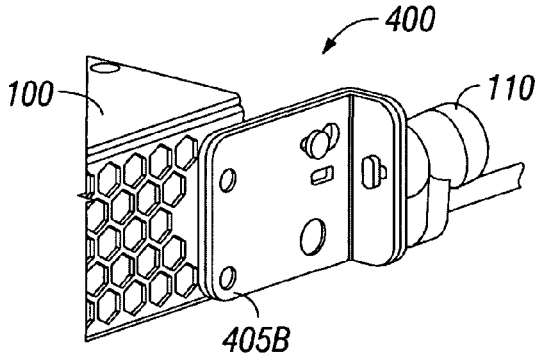
FIG. 4C is an enlarged view of the third securing mechanism with the second bracket attached to the first bracket and a lock in a first position in accordance with an exemplary embodiment.

FIG. 4C is an enlarged view of the third securing mechanism with the second bracket 405B directly attached to the first bracket 405A and a lock 110 in a first position in accordance with an exemplary embodiment. In this configuration, the flanges 430A and 430B extend outwardly away from the electronic device 100. The male protrusion 415A extends through the female hole 417B to temporarily secure the brackets together. In this first position, the lock 110 is attached at a first location (namely at the flanges 430A, 430B) of the securing mechanism 400.

Figure 4D:
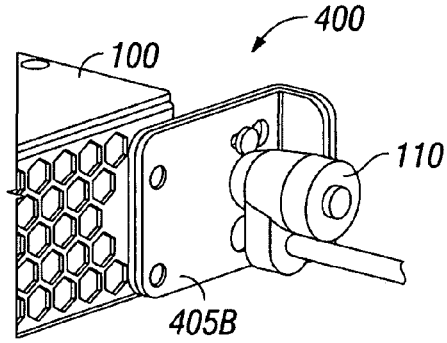
FIG. 4D is an enlarged view of the third securing mechanism with the second bracket attached to the first bracket and the lock in a second position in accordance with an exemplary embodiment.

FIG. 4D is an enlarged view of the third securing mechanism with the second bracket 405B directly attached to the first bracket 405A and the lock 110 in a second position in accordance with an exemplary embodiment. In this second position, the lock 110 is attached at a second location (namely at the attachment portions 420A, 420B) of the securing mechanism 400.

Figure 4E:
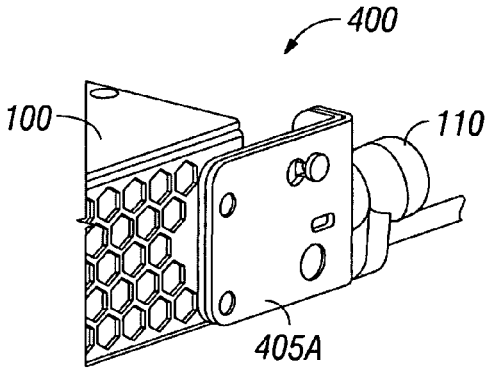
FIG. 4E is an enlarged view of the third securing mechanism with the first bracket attached to the second bracket and the lock in the first position in accordance with an exemplary embodiment.

FIG. 4E is an enlarged view of the third securing mechanism with the first bracket 405A directly attached to the second bracket 405B and the lock 110 in the first position in accordance with an exemplary embodiment. In this configuration, the flanges 430A and 430B extend inwardly toward the electronic device 100. In this first position, the lock 110 is attached at a first location (namely at the flanges 430A, 430B) of the securing mechanism 400.

Figure 4F:
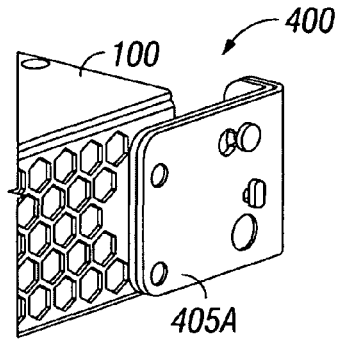
FIG. 4F is an enlarged view of the third securing mechanism with the first bracket attached to the second bracket and the lock in the second position in accordance with an exemplary embodiment.

FIG. 4F is an enlarged view of the third securing mechanism with the first bracket 405A directly attached to the second bracket 405B and the lock 110 in the second position in accordance with an exemplary embodiment. In this second position, the lock 110 is attached at a second location (namely at the attachment portions 420A, 420B) of the securing mechanism 400.

FIGS. 5A-5F show another embodiment wherein the securing mechanism 500 includes two separate brackets 505A and 505B. Each bracket includes a respective body 510A, 510B with an attachment portion 520A, 520B and flange 530A, 530B (see FIGS. 5A and 5B). Each bracket includes plural slots or openings 580 for attaching to the lock 110 (these slots or openings 580 discussed in more detail as slots or openings 280 in FIGS. 2A-2E). Reference is simultaneously made to all of the FIGS. 5A-5F with specific attention given to figures when indicated.

Figure 5A:
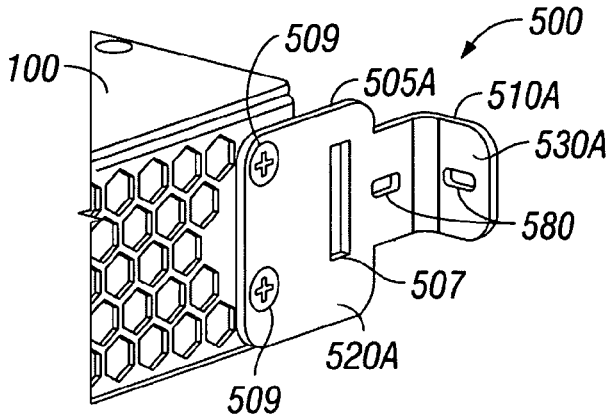
FIG. 5A is an enlarged view of a fourth securing mechanism with a first bracket attached to an electronic device in accordance with an exemplary embodiment.

FIG. 5A is an enlarged view of a fourth securing mechanism with the first bracket 505A directly attached to the electronic device 100 in accordance with an exemplary embodiment. The first bracket 505A includes an elongated rectangular slot or opening 507 that is shaped and sized to receive the flange 530B and a portion of the attachment portion shown as 510B of the second bracket 505B. Attachment of the second bracket 505B to the first bracket 505A is shown in more detail in FIGS. 5B-5D.

Figure 5B:
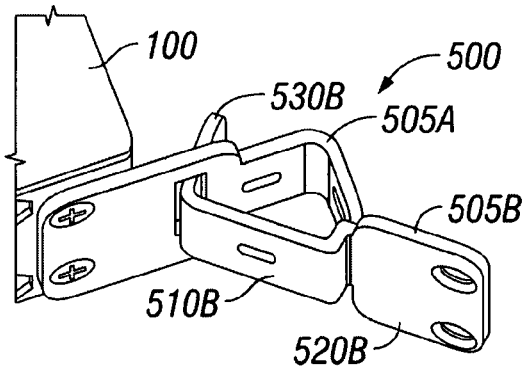
FIG. 5B is an enlarged view of the fourth securing mechanism with a second bracket being positioned through a hole of the first bracket in accordance with an exemplary embodiment.
Figure 5C:
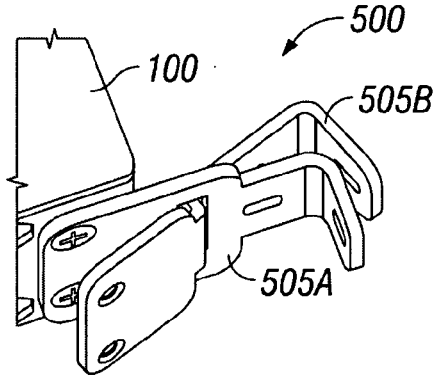
FIG. 5C is an enlarged view of the fourth securing mechanism with the second bracket being rotated to align with the first bracket in accordance with an exemplary embodiment.
Figure 5D:
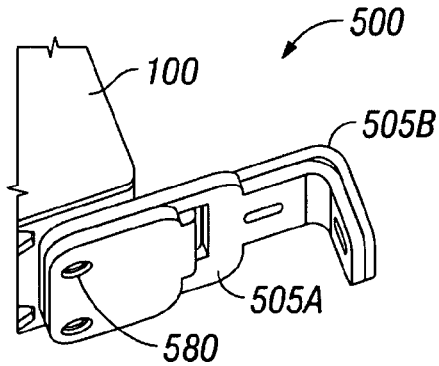
FIG. 5D is an enlarged view of the fourth securing mechanism with the second bracket being aligned with the first bracket in accordance with an exemplary embodiment.

In order to interlock the two brackets, the first bracket 505A is installed so the flange 530A extends outwardly away from the electronic device 100 as shown in FIG. 5A. Fasteners (such as flathead screws 509) attach the bracket to the electronic device 100. Next, the flange 530B of bracket 505B is inserted through the slot 507. FIG. 5B is an enlarged view of the fourth securing mechanism with the second bracket 505B being positioned through a slot 507 of the first bracket 505A. Next, the second bracket 505B is slid or rotated to align with the first bracket 505A. FIG. 5C is an enlarged view of the fourth securing mechanism with the second bracket 505B being rotated to align with the first bracket 505A. Next, the second bracket 505B is rotated until it is flush against the first bracket 505A. In other words, the second bracket is superimposed or laying on top of or adjacent to the first bracket. FIG. 5D is an enlarged view of the fourth securing mechanism with the second bracket 505B being aligned with the first bracket 505A.

Figure 5E:
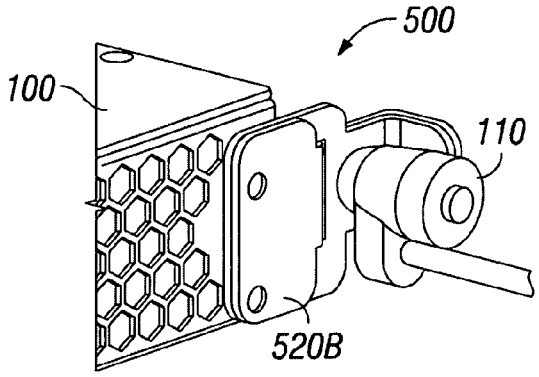
FIG. 5E is an enlarged view of the fourth securing mechanism with the first and second brackets attached to the electronic device and a lock in a first position in accordance with an exemplary embodiment.

FIG. 5E is an enlarged view of the fourth securing mechanism with the first and second brackets 505A, 505B attached to the electronic device 100 and the lock 110 in a second position in accordance with an exemplary embodiment. Here, the lock connects to the attachment portions of 520A, 520B, and the second bracket 505B covers or hides the fasteners 509. Thus, the second bracket 505B prevents a user from accessing the fasteners while the lock is attached to the securing mechanism. As such, a user is prevented from removing the securing mechanism (i.e., first and second brackets) from the electronic device while the lock is attached to the securing mechanism.

Figure 5F:
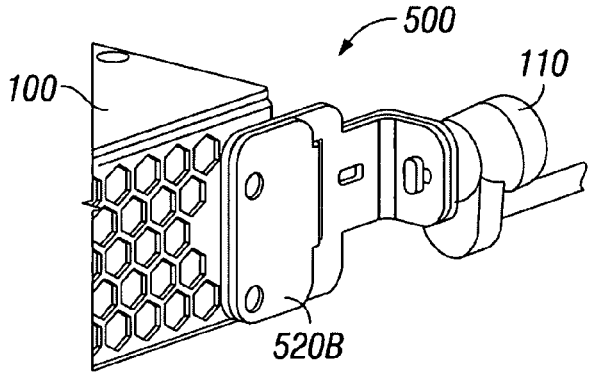
FIG. 5F is an enlarged view of the fourth securing mechanism with the first and second brackets attached to the electronic device and the lock in a second position in accordance with an exemplary embodiment.

FIG. 5F is an enlarged view of the fourth securing mechanism with the first and second brackets 505A, 505B attached to the electronic device 100 and the lock 110 in a first position in accordance with an exemplary embodiment. Here, the lock connects to the flanges of 530A, 530B. FIGS. 5A-5F show another embodiment wherein the securing mechanism 500 includes two separate brackets 505A and 505B. Each bracket includes a respective body 510A, 510B with an attachment portion 520A, 520B and flange 530A, 530B. Each bracket includes plural slots or openings 580 for attaching to the lock 110 (these slots or openings 580 discussed in more detail as slots or openings 280 in FIGS. 2A-2E).

Figure 6A:
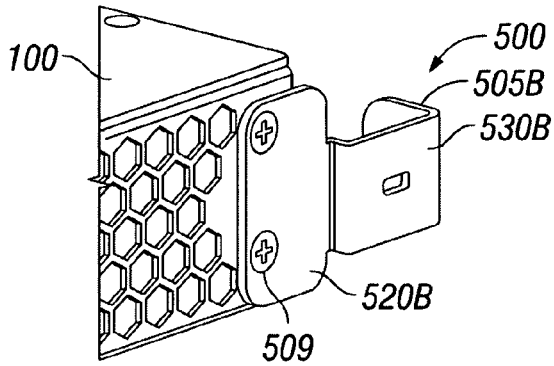
FIG. 6A is an enlarged view of the fourth securing mechanism with the second bracket attached to an electronic device in accordance with an exemplary embodiment.

FIG. 6A is an enlarged view of the fourth securing mechanism with the second bracket 505B directly attached to the electronic device 100 in accordance with an exemplary embodiment. In the embodiments of FIGS. 6A-6F, the first bracket 505A includes an elongated rectangular slot or opening 507 that is shaped and size to receive the flange 530B and a portion of the attachment portion 520B of the second bracket 505B. Attachment of the first bracket 505A to the second bracket 505B is shown in more detail in FIGS. 6B-6D. Reference is simultaneously made to all of the FIGS. 6A-6F with specific attention given to figures when indicated.

Figure 6B:
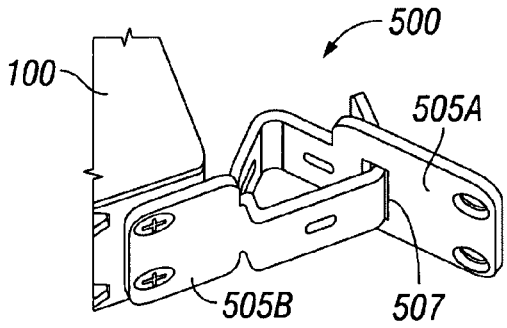
FIG. 6B is an enlarged view of the fourth securing mechanism with the hole in the first bracket being positioned over the end tip of the second bracket in accordance with an exemplary embodiment.
Figure 6C:
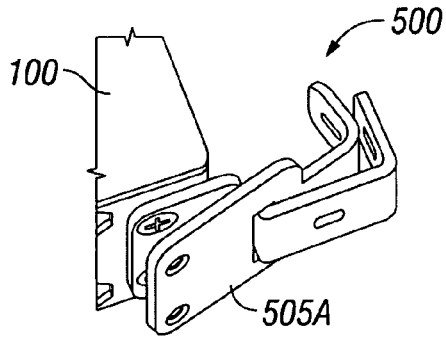
FIG. 6C is an enlarged view of the fourth securing mechanism with the first bracket being rotated to align with the second bracket in accordance with an exemplary embodiment.
Figure 6D:
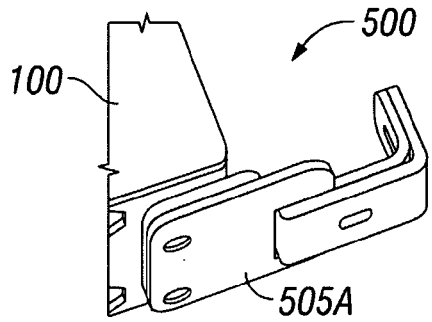
FIG. 6D is an enlarged view of the fourth securing mechanism with the first bracket being aligned with the second bracket in accordance with an exemplary embodiment.

In order to interlock the two brackets, the second bracket 505B is installed so the flange 530B extends inwardly toward the electronic device 100 as shown in FIG. 6A. Fasteners (such as flathead screws 509) attach the bracket to the electronic device 100. Next, the slot 507 of the first bracket 505A is inserted over the tab end 530B of the second bracket 505B. FIG. 6B is an enlarged view of the fourth securing mechanism with the first bracket 505A being positioned so that its slot 507 goes over the tab end of the second bracket 505B. Next, the first bracket 505A is slid or rotated to align with the second bracket 505B. FIG. 6C is an enlarged view of the fourth securing mechanism with the first bracket 505A being rotated to align with the second bracket 505B. Next, the first bracket 505A is rotated until it is flush against the second bracket 505B. In other words, the second bracket is superimposed or laying on top of or adjacent to the first bracket. FIG. 6D is an enlarged view of the fourth securing mechanism with the second bracket 505B being aligned with the first bracket 505A.

Figure 6E:
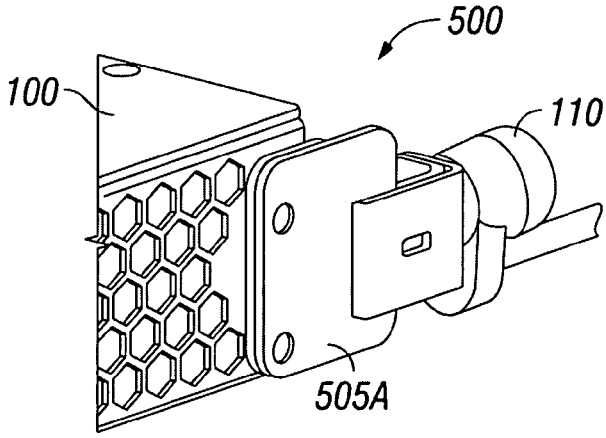
FIG. 6E is an enlarged view of the fourth securing mechanism with the first and second brackets attached to the electronic device and a lock in a first position in accordance with an exemplary embodiment.

FIG. 6E is an enlarged view of the fourth securing mechanism with the first and second brackets 505A, 505B attached to the electronic device 100 and the lock 110 in a first position in accordance with an exemplary embodiment. Here, the lock connects to the flanges 530A, 530B, and the first bracket 505A covers or hides the fasteners 509. Thus, the first bracket 505A prevents a user from accessing the fasteners while the lock is attached to the securing mechanism. As such, a user is prevented from removing the securing mechanism (i.e., first and second brackets) from the electronic device while the lock is attached to the securing mechanism.

Figure 6F:
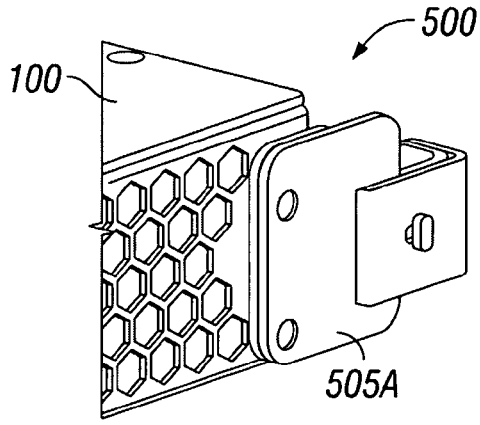
FIG. 6F is an enlarged view of the fourth securing mechanism with the first and second brackets attached to the electronic device and the lock in a second position in accordance with an exemplary embodiment.

FIG. 6F is an enlarged view of the fourth securing mechanism with the first and second brackets 505A, 505B attached to the electronic device 100 and the lock 110 in a second position in accordance with an exemplary embodiment. Here, the lock connects to the attachment portions 520A, 520B.

Exemplary embodiments are easy to install and remove (when the lock is removed) using standard hand tools (such as a screwdriver). Further, embodiments enable a standard lock (for example, a lock with a T-shaped connector sized and shaped to fit into a lock slot of a computer) to be installed either pointing towards or away from a side of the electronic device and also pointing towards the electronic device in a position that is both outside or inside the side of the electronic device. These various orientations provide flexibility in multiple attachment points and orientations for the security lock and thus minimize potential physical obstructions. Further, some embodiments use bent tabs or flanges on the brackets that allow for the lock to be positioned away from any existing protrusion on the back of the electronic device yet still be positioned almost within the side boundary of the electronic device.

In one embodiment, the two brackets are formed from sheet metal and require only bending and punching operations to make the brackets economical to produce. Since the brackets interlock together without the use of additional fasteners (for example, embodiments shown in FIGS. 5A-5F and 6A-6F), additional fasteners are not required to hold the two brackets together.

As used herein and in the claims, the word "superimposed" means to place or lay over or above something. For example, FIGS. 3A-3F, 4A-4F, 5A-5F, and 6A-6F show exemplary embodiments wherein one bracket is superimposed or laid over another bracket.

The above discussion is meant to be illustrative of the principles and various exemplary embodiments. Numerous variations and modifications will become apparent to those skilled in the art once the above disclosure is fully appreciated. It is intended that the following claims be interpreted to embrace all such variations and modifications.

What is claimed is:

1. A bracket assembly, comprising:

a first bracket to be removably connected to an electronic device with a fastener and including an opening that receives a lock; and a second bracket including an opening that receives the lock, the second bracket covering access to the fastener to prevent the first and second brackets from being disassembled while the lock is secured to the first and second brackets, wherein the openings in the first and second brackets include a slot sized and shaped to receive a T-shaped protrusion from the lock.

2. The bracket assembly of claim 1, wherein the second bracket has a shape of the first bracket and covers the first bracket while the first and second brackets are attached to the electronic device.

3. The bracket assembly of claim 1, wherein the opening of the first bracket aligns with the opening of the second bracket to receive the T-shaped protrusion from the lock.

4. A bracket assembly, comprising:

a first bracket to be removably connected to an electronic device with a fastener and including an opening that receives a lock; and a second bracket including an opening that receives the lock, the second bracket covering access to the fastener to prevent the first and second brackets from being disassembled while the lock is secured to the first and second brackets, wherein the first and second brackets both include a hole that is to receive a screw to secure to the electronic device.

5. The bracket assembly of claim 1, wherein the first and second brackets both have an attachment portion that is to connect to the electronic device and a flange that extends perpendicular from the attachment portion.

6. The bracket assembly of claim 1, wherein the first bracket includes an extension and the second bracket includes a slot, the extension extending through the slot to hold the first and second brackets together.

7. A bracket assembly, comprising:

a first bracket including an opening and being removably connectable to an electronic device with a fastener; and a second bracket having one end that extends through the opening to superimpose the second bracket on the first bracket and cover access to the fastener to prevent disassembly of the first and second brackets from the electronic device while the lock is locked to the first and second brackets, wherein the first and second brackets have an L-shape.

8. The bracket assembly of claim 7, wherein the first and second brackets both include a slot to engage the lock, the slot in the first bracket aligning with the slot in the second bracket when the first and second brackets are superimposed.

9. The bracket assembly of claim 7, wherein the second bracket includes an attachment portion and a flange extending outwardly from the attachment portion, the flange being sized and shaped to fit through the opening until the attachment portion contacts the first bracket.

10. A bracket assembly, comprising:

a first bracket including an opening and being removably connectable to an electronic device with a fastener; and a second bracket having one end that extends through the opening to superimpose the second bracket on the first bracket and cover access to the fastener to prevent disassembly of the first and second brackets from the electronic device while the lock is locked to the first and second brackets, wherein the first and second brackets both include plural slots to receive and engage the lock such that the lock attaches to the first and second brackets in two different positions.

11. A bracket assembly, comprising:

a first bracket including an opening and being removably connectable to an electronic device with a fastener; and a second bracket having one end that extends through the opening to superimpose the second bracket on the first bracket and cover access to the fastener to prevent disassembly of the first and second brackets from the electronic device while the lock is locked to the first and second brackets, wherein the first and second brackets interchangeably connect to the electronic device to provide multiple different locations for the lock to connect to the first and second brackets.

12. The bracket assembly of claim 7, wherein the first and second brackets provide an attachment mechanism for the lock to secure the electronic device from theft.

13. A bracket assembly, comprising:

a first bracket including an opening and being removably connectable to an electronic device with a fastener; and a second bracket having one end that extends through the opening to superimpose the second bracket on the first bracket and cover access to the fastener to prevent disassembly of the first and second brackets from the electronic device while the lock is locked to the first and second brackets, wherein the first and second brackets are superimposed to attach to the electronic device in a first orientation with flanges on the first and second brackets extending away from the electronic device and to attach to the electronic device in a second orientation with the flanges extending toward the electronic device.

14. A method, comprising:

fastening a first bracket to an electronic device with a removable fastener;

superimposing a second bracket over the first bracket to cover access to the removable fastener;

extending a lock through the first and second brackets to prevent theft of the electronic device and to prevent disassembly of the first and second brackets; and attaching the lock to multiple different locations on the first and second brackets while the first and second brackets are secured to the electronic device.

15. The method of claim 14 further comprising, extending a portion of the second bracket through an opening in the first bracket to superimpose the first and second brackets.

16. The method of claim 14 further comprising, aligning slots in both the first and second brackets to receive the lock.

17. A method, comprising:

fastening a first bracket to an electronic device with a removable fastener;

superimposing a second bracket over the first bracket to cover access to the removable fastener;

extending a lock through the first and second brackets to prevent theft of the electronic device and to prevent disassembly of the first and second brackets; and rotating the second bracket around a portion of the first bracket to align the first and second brackets before extending the lock through the first and second brackets.

* * * * *